United States Patent [19]

Chiang

[11] Patent Number: 4,626,326

[45] Date of Patent: Dec. 2, 1986

[54] ELECTROLYTIC PROCESS FOR MANUFACTURING PURE POTASSIUM PEROXYDIPHOSPHATE

[75] Inventor: John S. C. Chiang, Mercerville, N.J.

[73] Assignee: FMC Corporation, Philadelphia, Pa.

[21] Appl. No.: 741,785

[22] Filed: Jun. 6, 1985

[51] Int. Cl.[4] ..... C25B 1/28

[52] U.S. Cl. ..... 204/82

[58] Field of Search ..... 204/82

[56] References Cited

U.S. PATENT DOCUMENTS

| | | | |
|---|---|---|---|
| 1,988,059 | 1/1935 | van Loon | 204/82 |
| 2,135,545 | 11/1938 | Voelkel | 204/82 |
| 2,795,541 | 6/1957 | Muller | 204/82 |
| 3,607,142 | 9/1971 | Mucenieks | 23/302 |
| 3,616,325 | 10/1971 | Mucenieks | 204/82 |

FOREIGN PATENT DOCUMENTS

| | | | |
|---|---|---|---|
| 2261225 | 9/1975 | France . | |
| 231533 | 8/1969 | U.S.S.R. | 204/82 |
| 323942 | 4/1975 | U.S.S.R. | 204/82 |
| 1089174 | 4/1984 | U.S.S.R. . | |

OTHER PUBLICATIONS

Battaglia et al, "The Dissociation Constants and the Kinetics of Hydrolysis of Peroxymonophosphoric Acid", *Inorganic Chemistry,* vol. 4, No. 4, Apr. 1965, pp. 552–558.

Tyurikova et al, "Certain Features of the Electrochemical Synthesis of Perphosphates from Phosphate Solutions Without Additives", Elektrokhimiya, vol. 16, No. 2, pp. 226–230, Feb., 1980.

*Primary Examiner*—T. Tung

*Attorney, Agent, or Firm*—Richard E. Elden; Robert L. Andersen; Eugene G. Seems

[57] ABSTRACT

The invention provides a process to manufacture fluoride-free potassium peroxydiphosphate on a commercial scale. The process comprises electrolyzing an alkaline anolyte containing potassium, phosphate, nitrate and hydroxyl ions at a platinum or noble metal anode. The catholyte is separated from the anolyte by a separating means permeable to at least one ion contained in the anolyte or catholyte.

12 Claims, No Drawings

ELECTROLYTIC PROCESS FOR MANUFACTURING PURE POTASSIUM PEROXYDIPHOSPHATE

An electrolytic process is provided for manufacturing fluoride-free potassium peroxydiphosphate on a commercial scale.

Potassium peroxydiphosphate is known to be a useful peroxygen compound, but it is not yet an article of commerce because of fluoride in the product and the problems of converting an electrolytic laboratory-scale process to a commercial-scale process. The problems are based on several factors. The productivity of an electrolytic process increases directly with amperage while power loss increases with the square of the current. The predominant electrochemical reaction differs with a change in voltage, and the cost of a commercial process is a function of the total power consumed in rectifying and distributing the electrical energy and not merely on the amperage of the cell. The present invention provides a process to electrolyze a phosphate solution to produce potassium peroxydiphosphate substantially free from fluoride contamination. A high efficiency is attained by providing a nitrate additive and by controlling the pH of the anolyte.

U.S. Pat. No. 3,616,325 to Mucenieks (the "'325 patent"), incorporated herein by reference, teaches that potassium peroxydiphosphate can be produced on a commercial scale by oxidizing an alkaline anolyte containing both potassium phosphate and a fluoride at a platinum anode. The potassium phosphate catholyte is separated from the anolyte by a diaphragm. At the stainless steel cathode hydrogen is formed by the reduction of hydrogen ions.

French Pat. No. 2,261,225 teaches a continuous process for producing potassium peroxydiphosphate electrolytically in an alkaline potassium phosphate electrolyte containing fluoride ions. The cell employs a cylindrical zirconium cathode, a platinum anode and does not contain a diaphragm. The product from the process of the French patent also has the disadvantage of fluoride contamination.

U.S. Pat. No. 3,607,142 to Mucenieks teaches a process for recovering nonhygroscopic crystals of potassium peroxydiphosphate from an anolyte solution, but even on recrystallization the process is able to achieve only partial elimination of fluoride from the crystals.

Battaglia et al, "The Dissociation Constants and the Kinetics of Hydrolysis of Peroxymonophosphoric Acid," *Inorganic Chemistry*, 4, pages 552–558 (1965) discloses that the fluoride ion has a strong affinity for the tetrahedral phosphorus atom in peroxydiphosphate. This affinity explains the difficulty of removing fluoride from peroxydiphosphate by crystallization. As the fluoride ion is recognized to be toxic and is corrosive, the processes requiring fluoride are not suitable for commercial production of fluoride-free potassium peroxydiphosphate without extensive purification.

Tyurikova et al, "Certain Features of the Electrochemical Synthesis of Perphosphates from Phosphate Solutions Without Additives", Elektrokhimiya, Volume 16, No. 2, pages 226–230, February 1980, reports that potassium peroxydiphosphate can be produced without using any additives. The initial current efficiency of 53% can be obtained only after acid cleaning the anode. Even with this treatment, the efficiency drops to under 20% in 5 hours.

Russian Pat. No. 1,089,174 issued to Miller, Tyurikova and Laureniteva teaches the use of "promoting agents" other than fluoride ion, thereby avoiding the necessity of recrystallizing the potassium peroxydiphosphate to remove the undesired fluoride ion and to minimize platinum loss at the anode. However, the promoting agents are potassium chloride, potassium thiocyanate, thiourea and sodium sulfite. Potassium chloride is not suitable for use in a commercial process as it is well-known that halides are highly corrosive to platinum. Potassium thiocyanate, thiourea and sodium sulfite are toxic. Other additives, such as nitrates, are neither taught nor suggested.

In accordance with this invention, the presence of nitrate provides an electrolytic process capable of operating at an anode current density of at least 0.05 $A/cm^2$ and of producing potassium peroxydiphosphate free from fluoride at a current efficiency of at least 15% without interruption for a period of time sufficient to produce a solution containing at least 10% potassium peroxydiphosphate.

The process of the present invention is carried out as a continuous or batch process in an electrolytic cell or a plurality of electrolytic cells. Each cell has at least one anode compartment containing an anode and at least one cathode compartment containing a cathode. The compartments are separated by a separating means which prevents a substantial flow of an aqueous liquid between the anode and cathode compartments and which is substantially permeable to an aqueous ion.

The process comprises introducing into the anode compartment an aqueous anolyte solution substantially free from fluoride or other halide ions, said solution comprising phosphate, hydroxyl, and nitrate anions and potassium cations. The hydroxyl anions are present in sufficient quantity to maintain the anolyte between pH 9.5 and pH 14.5. An aqueous solution substantially free of fluoride or other halide ions is concomitantly introduced into the cathode compartment as a catholyte. The catholyte contains ions which will permit the desired cathode half-cell reaction to take place. It is desirable for the catholyte to contain at least one of the ions in the anolyte. The electrolysis is effected by applying sufficient electric potential between the anode and the cathode to induce an electric current to flow through the anolyte and catholyte to oxidize phosphate ions to peroxydiphosphate ions. Anolyte containing potassium peroxydiphosphate is withdrawn from an anode compartment and, optionally, solid potassium peroxydiphosphate may be crystallized from it by any convenient method.

The anode can be fabricated from any electrically conductive material which does not react with the anolyte during electrolysis such as platinum, gold or any other noble metal.

Similarly, the cathode may be fabricated from any material which conducts an electric current and does not introduce unwanted ions into the catholyte. The cathode surface can be carbon, nickel, zirconium, hafnium, a noble metal or an alloy such as stainless steel or zircalloy. Desirably, the cathode surface will promote the desired cathode half-cell reaction, such as the reduction of water to form hydrogen gas or the reduction of oxygen gas to form hydrogen peroxide.

The cathode and anode can be fabricated in any configuration, such as plates, ribbons, wire screens, cylinders and the like. Either the cathode or the anode may be fabricated to permit coolant to flow therethrough or, alternatively, to conduct a fluid, including the anolyte or catholyte, into or out of the cell. For example, if the cathode reaction is the reduction of oxygen gas to form hydrogen peroxide, a gas containing oxygen can be introduced into the cell through a hollow cathode, or if agitation of the anolyte is desired, an inert gas can be introduced through a hollow anode.

The cells may be arranged in parallel or in series (cascade) and may be operated continuously or batchwise.

An electric potential is applied between the anode and cathode, which potential must be sufficient not only to oxidize phosphate ions to peroxydiphosphate ions, but also to effect the half-cell reduction at the cathode and to cause a net flow of ions between the anode and the cathode equivalent either to a flow of anions, negative ions, from cathode to anode or to a flow of cations, positive ions, from the anode to the cathode. Normally, an anode half-cell potential of at least about 2 volts has been found operable. When the cathode reaction is the reduction of water to form hydrogen gas, an overall cell voltage of about 3 to 8 volts is preferred.

The temperature of the anolyte and catholyte is not critical. Any temperature may be employed at which the aqueous electrolyte is liquid. A temperature of at least 10° C. is desirable to prevent crystallization in the anolyte and catholyte and a temperature of 90° C. or less is desirable to avoid excessive evaporation of water from the aqueous fluid. Temperatures of from 20° C. to 50° C. are preferred and more preferably from 30° C. to 40° C.

It is critical for the present invention for the anolyte to be substantially free of fluoride ions as they are known to be toxic and have an affinity for the phosphorus atoms in a peroxydiphosphate ion. It is also critical for the anolyte to be free of other halide ions, such as chloride and bromide ions, which are known to be oxidized to hypohalites in competition to the desired anode reaction of oxidizing phosphate ions to form a peroxydiphosphate ion. Further, halide ions are known to be corrosive. It is also critical for the anolyte to contain phosphate, hydroxyl, and nitrate anions and potassium cations.

It is desirable for the anolyte to contain sufficient phosphorus atoms to be about equivalent to a 1 molar to 4 molar (1 M to 4 M) solution of phosphate ions, preferably 2 to 3.75 molar. The ratio of the potassium to phosphorus atoms, the K:P ratio, should range from 2:1 to 3.2:1; preferably, 2.5:1 to 3.0:1. It is critical for the concentration of nitrate ions in the anolyte to be at least about 0.015 molar, preferably at least 0.15 molar. The maximum nitrate concentration is limited only by the solubility of potassium nitrate in the anolyte, about 0.5 mols/liter potassium nitrate at 25° C. when the anolyte contains 3.5 M phosphate and has a K:P ratio of 2.8:1, and about 0.8 mols/liter at 30° C. when the anolyte is 3 M in phosphate with a K:P ratio of 2.7:1.

The nitrate may be incorporated into the anolyte in any convenient form such as nitric acid, potassium nitrate, sodium nitrate, lithium nitrate or ammonium nitrate. The nitrate may also be incorporated into the anolyte by adding any form of nitrogen capable of forming nitrate in the anode compartment such as nitrite, ammonium or a nitrogen oxide. It is preferable to incorporate the nitrate as a potassium salt, nitric acid or any other form which does not introduce a persistent ionic species into the anolyte.

It is critical for sufficient hydroxyl ions to be incorporated into the anolyte to maintain the anolyte between pH 9.5 and pH 14.5. Preferably, the anolyte should be maintained between pH 12 and pH 14. Although the best means of practicing the present invention is not dependent upon any particular mechanism of operation, it is convenient to explain a decrease in efficiency above pH 14.5 with an increase in the hydroxyl ion concentration thereby favoring an increase of the formation of oxygen from the oxidation of hydroxyl ions.

The anode and the cathode compartments are separated by a separating means which prevents a substantial flow of liquid between compartments. The separating means must be permeable to at least one aqueous ion in the anolyte or catholyte, thereby permitting an electric current to flow between the anode and cathode. For example, the separating means can be a membrane permeable to cations such as potassium to permit the cations to be transferred from the anode compartment to the cathode compartment, or permeable to anions such as phosphate to permit anions to be transferred from the cathode compartment to the anode compartment. The separating means can also be a porous diaphragm permitting both cations and anions to be transferred from one compartment to the other. A diaphragm can be fabricated from any inert porous material such as a ceramic, polyvinyl chloride, polypropylene, polyethylene, a fluoropolymer or any other convenient material.

The composition of the catholyte can be selected to contain any convenient ions or mixtures of ions depending upon the cathode reaction desired and the inertness of the separating means between the anode compartment and the cathode compartment. Usually, it is desirable for the catholyte to contain at least one of the ions present in the anolyte to reduce the potential across the separating means between the anode and cathode compartment and to avoid introducing unwanted, ionic species into the anolyte. For example, if the separating means is a porous ceramic diaphragm and the cathodic reaction is the formation of hydrogen, it is convenient for the catholyte to be a solution of potassium, phosphate and hydroxyl ions. However, if the separating means is an ion selective membrane, and the cathode reaction is the reduction of oxygen to hydrogen peroxide, the catholyte can contain sodium hydroxide, and optionally, sodium nitrate or sodium phosphate.

The best mode of practicing the present invention will be evident to one skilled in the art from the following examples. For uniformity, the examples are in terms of a cell consisting of a platinum anode immersed in an anolyte, a porous diaphragm, and a nickel cathode immersed in a potassium hydroxide catholyte. The cathode reaction is the reduction of water to form hydroxyl ions and hydrogen gas. The electrolytic cell was fabricated from methylmethacrylate resin with inside dimensions of 11.6 cm×10 cm×5.5 cm. A porous ceramic diaphragm separated the cell into anode and cathode compartments. The anode was made of platinum ribbon strips with a total surface area of 40.7 $cm^2$. The cathode was nickel with an area of about 136 $cm^2$.

EXAMPLE I

The initial phosphate concentration of the anolyte was 3.5 M and the K:P ratio was 2.65:1. The nitrate concentration was varied from 0 to 0.38 M (0 to 2.5% $KNO_3$). The initial pH of the anolyte solution was about 12.7 at room temperature. The catholyte was about 8.26 M (34.8%) KOH.

The anolyte and catholyte solutions were introduced into the cell and an electric potential of about 4.8 volts was applied causing 6.1 A current flow for 5 hours at 30° C. The anode current density was calculated to be about 0.15 A/cm$^2$. Results are tabulated as Table I. Run No. 1 shows that, without the use of nitrate, a current efficiency of 3.8% was obtained resulting in a very low concentration of potassium peroxydiphosphate in the anolyte. Run Nos. 2 to 4 show the positive effect nitrate ion has on current efficiency.

REPLICATION OF TYURIKOVA ET AL PROCESS

The process reported by Tyurikova et al, "Certain Features of the Electrochemical Synthesis of Perphosphate Solutions Without Additives", supra was repeated with and without the electrode cleaning used there. The results are reported as Table II. The example was similar to Example I except a platinum anode with a surface area of about 18 cm$^2$ was used and, for the first three experiments, the anode was cathodically cleaned in 1 N $H_2SO_4$ followed by treatment with a dilute (1:1) aqua regia and by washing with deionized water prior to the experiment. The phosphate concentration of the anolyte was about 4 M and the K:P ratio was about 2.6:1. The pH of the anolyte solution was 12.7. The electric potential applied to the cell was about 3.8 volts and the electric current was about 0.64A for an anode current density of 0.036 A/cm$^2$. The electrolysis was carried out at a low temperature of 23° C. for one to five hours.

It is clear that the process reported by Tyurikova et al is not suitable for a commercial-scale process as it is impractical to perform the necessary electrode cleaning. Further, current efficiencies of at least 10% were obtained only when producing product concentrations of under 2% peroxydiphosphate at anode current densities of under 0.05 A/cm$^2$, both of which are too low for a commercial-scale process. Even further, the electrode cleaning must be repeated every five hours.

EXAMPLE II

A series of anolyte solutions were prepared to contain 3.5 M/l phosphate ion with a K:P mol ratio varying from 2.5:1 to 3.0:1. The solutions were electrolyzed at a current density of 0.15 A/cm$^2$ at 30° C. The pH and $K_4P_2O_8$ assay were determined after 90, 180, 270 and 300 minutes. The data are presented as Table III.

The data show the relationship between current efficiency, $K_4P_2O_8$ concentration and K:P ratio. The current efficiency appears to vary directly with the unoxidized phosphate remaining in the solution.

EXAMPLE III

The process of Example I was repeated using an anolyte feed containing 1% $K_4P_2O_8$ which was 2.4 M in phosphate, 0.72 M in nitrate and with a K:P ratio of 2.65:1. A 4.45 v potential maintained a current density of 0.15 A/cm$^2$ for 150 minutes at 30° C. The anolyte product had a pH of 13.2, and assayed 12.6% potassium peroxydiphosphate for a 30% current efficiency.

EXAMPLE IV

Example III was repeated with an anolyte feed which was 3 M in phosphate, 0.74 M in nitrate and with a K:P ratio of 2.7:1. A 4.07 v potential maintained a 0.1 A/cm$^2$ current density for 150 minutes at 40° C. The anolyte product had a pH of 12.8 and assayed 11.5% potassium peroxydiphosphate for a current efficiency of 44%.

TABLE I

EFFECT OF NITRATE ION ON CURRENT EFFICIENCY

| Run No. | Molarity $KNO_3$ | Current* Efficiency, % | Product* $K_4P_2O_8$, % | Final pH |
|---|---|---|---|---|
| 1 | 0.0 | 3.8 | 2.8 | 11.8 |
| 2 | 0.015 | 6.9 | 5.1 | 12.1 |
| 3 | 0.152 | 17.5 | 12.7 | 12.5 |
| 4 | 0.381 | 24.8 | 18.0 | 13.2 |

*Overall after 300 minutes at 0.15 A/cm$^2$.

TABLE II

REPLICATION OF TYURIKOVA ET AL PROCESS

| Run No. | Electrolysis Time, min. | Anode Cleaning | Current* Efficiency, % | Conc. $K_4P_2O_8$, % Init. | Final |
|---|---|---|---|---|---|
| 1 | 60 | Yes | 53.3 | 0 | 0.8 |
| 2 | 180 | Yes | 35.9 | 0 | 1.5 |
| 3 | 300 | Yes | 20.9 | .5 | 2.0 |
| 4 | 300 | No | 8.4 | .9 | 1.6 |
| 5 | 300 | No | 7.6 | 1.3 | 1.9 |

*0.036 A/cm$^2$.

TABLE III

CURRENT EFFICIENCY OF ANOLYTE SOLUTIONS CONTAINING 2.5% $KNO_3$

| K:P Ratio | Min. | pH | $K_4P_2O_8$, % | Current* Efficiency, % |
|---|---|---|---|---|
| 2.5:1 | 0 | 12.08 | 0.0 | — |
| | 90 | 11.81 | 5.8 | 27.6 |
| | 180 | 11.63 | 10.1 | 18.9 |
| | 270 | 11.43 | 13.0 | 12.0 |
| | 360 | 11.20 | 14.7 | 6.5 |
| | | | | 16.3 Av. |
| 2.6:1 | 0 | 12.32 | 0.0 | — |
| | 90 | 12.12 | 7.1 | 32.3 |
| | 180 | 12.06 | 12.3 | 22.9 |
| | 270 | 11.83 | 16.2 | 16.2 |
| | 360 | 11.67 | 18.6 | 9.5 |
| | | | | 20.2 Av. |
| 2.7:1 | 0 | 12.66 | 0.0 | — |
| | 90 | 12.52 | 8.0 | 36.4 |
| | 180 | 12.48 | 13.6 | 24.3 |
| | 270 | 12.36 | 18.0 | 18.4 |
| | 360 | 12.32 | 20.9 | 11.6 |
| | | | | 22.7 Av. |
| 2.8:1 | 0 | 13.04 | 0.0 | — |
| | 90 | 12.95 | 7.9 | 37.3 |
| | 180 | 12.91 | 13.7 | 26.5 |
| | 270 | 12.80 | 18.2 | 19.6 |
| | 360 | 12.52 | 21.4 | 12.7 |
| | | | | 24.0 Av. |
| 2.9:1 | 0 | 13.57 | 0.0 | — |
| | 90 | 13.57 | 7.8 | 37.3 |
| | 180 | 13.70 | 13.6 | 26.8 |
| | 270 | 13.61 | 18.4 | 20.6 |
| | 360 | 13.49 | 22.0 | 15.1 |
| | | | | 25.0 Av. |
| 3.0:1 | 0 | 14.47 | 0.0 | — |
| | 90 | 14.65 | 7.2 | 34.7 |
| | 180 | 14.58 | 12.1 | 22.8 |
| | 270 | 14.38 | 16.6 | 19.5 |
| | 360 | 14.26 | 20.3 | 15.9 |
| | | | | 23.2 Av. |

*0.15 A/cm$^2$.

What is claimed is:

1. A process for producing potassium peroxydiphosphate in an electrolytic cell or plurality of cells, wherein each cell comprises an anode compartment containing an anode, a cathode compartment containing a cathode, and separating means which prevents a substantial flow of an aqueous liquid between the anode compartment and the cathode compartment and which is substantially permeable to an aqueous ion, said process comprising introducing into the anode compartment an aqueous anolyte substantially free from fluoride or other halide ions, said anolyte comprising potassium cations, phosphate anions, hydroxyl anions, and at least 0.015 mols per liter of nitrate anions, the hydroxyl anions being present in sufficient quantity to maintain the anolyte between pH 9.5 and pH 14.5; introducing into the cathode compartment an aqueous catholyte solution substantially free from fluoride or other halide anions, said catholyte containing at least one of the ions present in the anolyte, and applying sufficient electric potential between the anode and the cathode to cause an electric current to flow through said catholyte and anolyte whereby phosphate anions are oxidized at the anode to form peroxydiphosphate anions.

2. The process of claim 1 wherein the anolyte is maintained between pH 12 and pH 14.

3. The process of claim 2 wherein the anolyte phosphate anion concentration is between 1 molar and 4 molar and the K:P ratio is between 2:1 and 3.2:1.

4. The process of claim 2 wherein the anolyte phosphate anion concentration is between 2 molar and 3.75 molar and the K:P ratio is between 2.5:1 and 3.0:1.

5. The process of claim 1 wherein the anolyte phosphate anion concentration is between 1 molar and 4 molar and the K:P ratio is between 2:1 and 3.2:1.

6. The process of claim 1 wherein the anolyte phosphate anion concentration is between 2 molar and 3.75 molar and the K:P ratio is between 2.5:1 and 3.0:1.

7. A process for producing potassium peroxydiphosphate in an electrolytic cell or plurality of cells, wherein each cell comprises an anode compartment containing an anode, a cathode compartment containing a cathode, and separating means which prevents a substantial flow of an aqueous liquid between the anode compartment and the cathode compartment and which is substantially permeable to an aqueous ion, said process comprising introducing into the anode compartment an aqueous anolyte substantially free from fluoride or other halide ions, said anolyte comprising potassium cations, phosphate anions, hydroxyl anions, and from 0.15 to 0.8 mols per liter of nitrate anions, the hydroxyl anions being present in sufficient quantity to maintain the anolyte between pH 9.5 and pH 14.5; introducing into the cathode compartment as a catholyte an aqueous solution substantially free from fluoride or other halide anions, said catholyte containing at least one of the ions present in the anolyte, applying sufficient electric potential between the anode and the cathode to cause an electric current to flow through said catholyte and anolyte whereby phosphate anions are oxidized at the anode to form per-oxydiphosphate anions, and withdrawing anolyte containing po-tassium peroxydiphosphate from an anode compartment.

8. The process of claim 7 wherein the anolyte is maintained between pH 12 and pH 14.

9. The process of claim 8 wherein the anolyte phosphate anion concentration is between 1 molar and 4 molar and the K:P ratio is between 2:1 and 3.2:1.

10. The process of claim 8 wherein the anolyte phosphate anion concentration is between 1 molar and 4 molar and the K:P ratio is between 2.5:1 and 3.0:1.

11. The process of claim 7 wherein the anolyte phosphate anion concentration is between 1 molar and 4 molar and the K:P ratio is between 2:1 and 3.2:1.

12. The process of claim 7 wherein the anolyte phosphate anion concentration is between 2 molar and 3.75 molar and the K:P ratio is between 2.5:1 and 3.0:1.

* * * * *